United States Patent [19]

Johnson

[11] Patent Number: 4,766,514

[45] **Date of Patent: * Aug. 23, 1988**

[54] PSEUDO-MOBIUS STATIC-RESISTANT CIRCUIT CONTAINER

[76] Inventor: Kevin L. Johnson, 3248 Northampton Ct., Pleasanton, Calif. 94566-3532

[ * ] Notice: The portion of the term of this patent subsequent to Dec. 23, 2004 has been disclaimed.

[21] Appl. No.: 927,682

[22] Filed: Nov. 6, 1986

[51] Int. Cl.[4] ..... H05F 1/02

[52] U.S. Cl. ..... 361/220; 206/328; 428/922

[58] Field of Search ..... 361/212, 215, 220; 206/328; 428/922

[56] References Cited

U.S. PATENT DOCUMENTS 4,424,900 1/1984 Petcavich ..... 206/328

4,528,222 7/1985 Rzepecki et al. ..... 361/212 X

*Primary Examiner*—Michael L. Gellner

*Assistant Examiner*—Brian W. Brown

[57] ABSTRACT

This container, through its pseudo-mobius strip design, will control the introduction of static electricity to the electronic circuits it houses. Static electricity would have to overcome it's tendency not to enter an internal surface, as demonstrated by Faraday. The internal surface presented in this container is uniquely more difficult for static electricity to enter than that of existing containers.

3 Claims, 2 Drawing Sheets

PSEUDO-MOBIUS STATIC-RESISTANT CIRCUIT CONTAINER

This container, through it's unique psuedo-mobius strip design, will help prevent the introduction of static electricity to the circuits housed within it.

Figure 1:
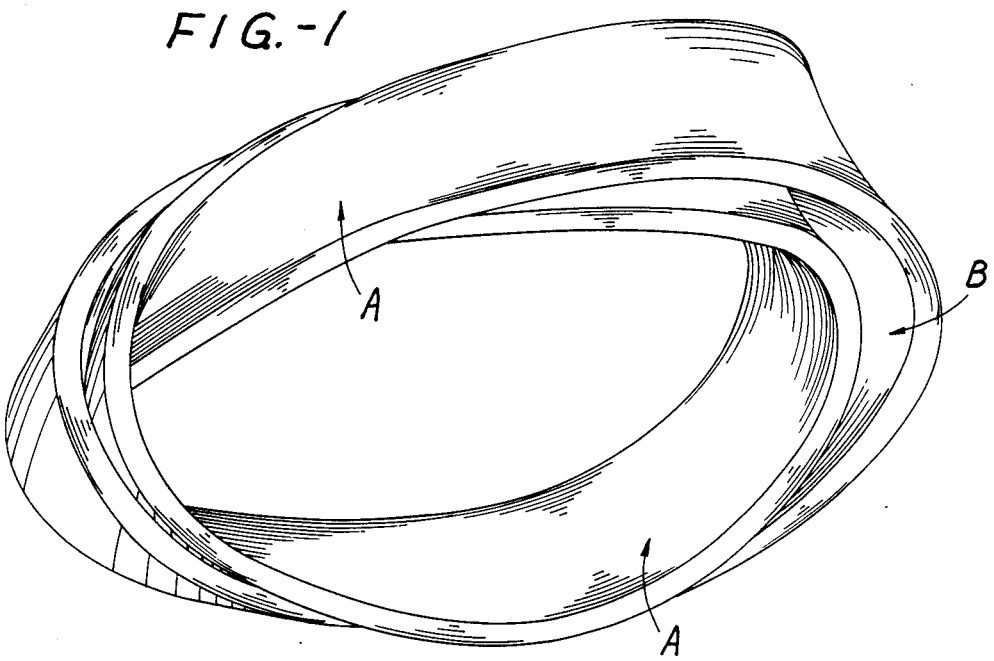
FIG. 1 is a view of an assembled psueda-mobius container with the letter "A" representing the continous external surface.
Figure 2:
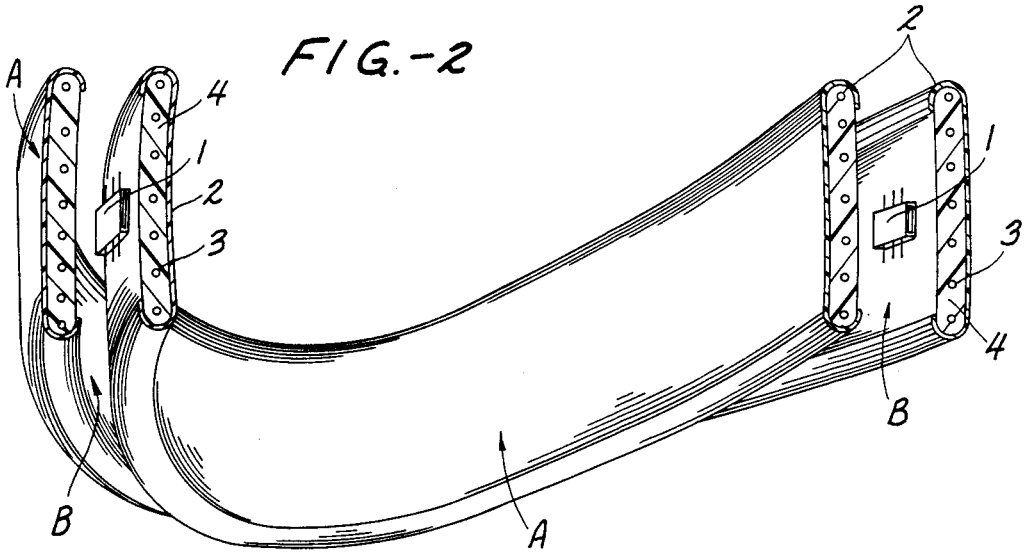
FIG. 2 is a view of the external surface "A".
Figure 3:
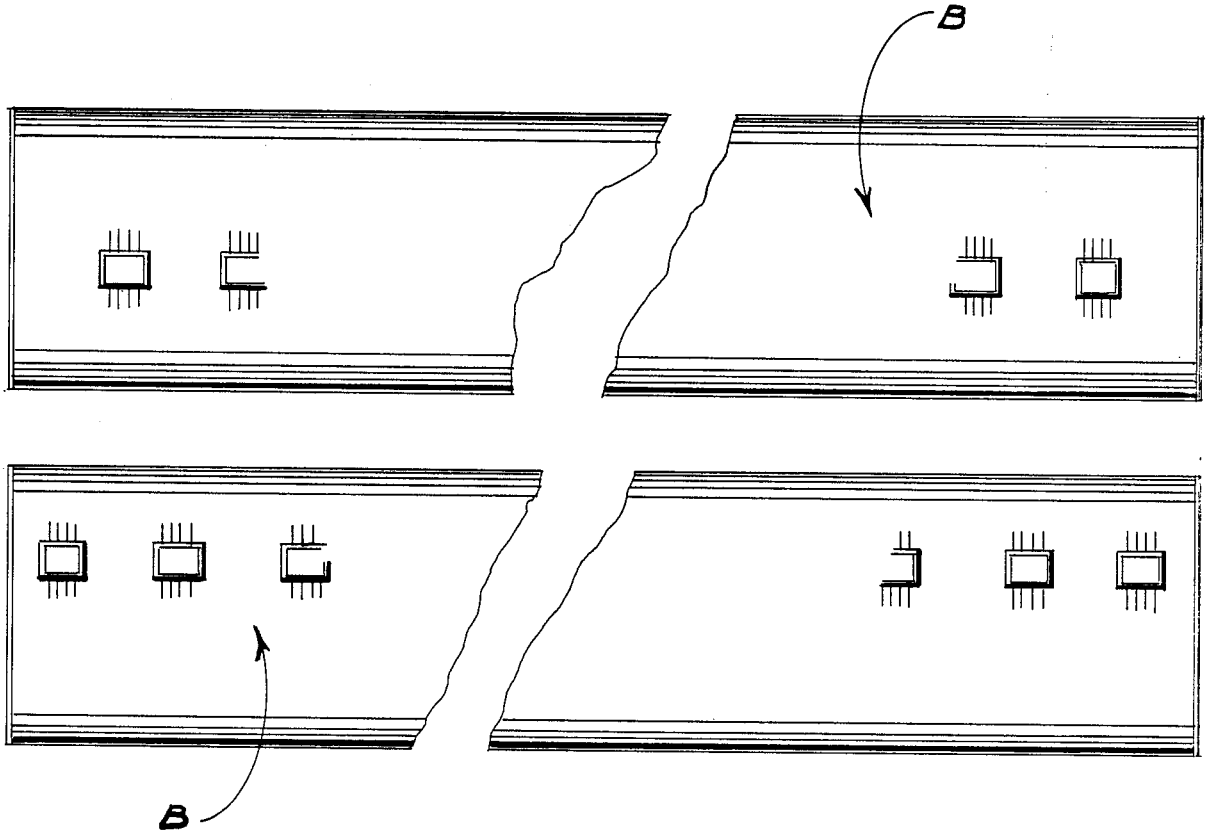
FIG. 3 is a view of the internal surface "B" having a circuit 1 shown therein.
Figure 4:
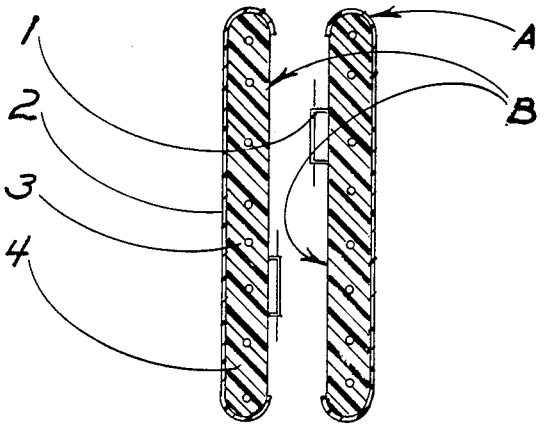
FIG. 4 is a cross-sectional view of a strip showing the internal conductive wires.

The design of the container will be based on the single surfaced three dimensional object known as the mobius strip. The design is psuedo-mobius because the strip actually has two sides versus the single surface of the mobius strip. The method of constructing the structure creates a container (as it has an internal surface) whose external surface mimics a mobius strip. Two equally sized, double sided special strips will be used to create the container. The strips will be aligned on top of each other lengthwise. The two strips together will then be given a one hundred and eighty degree twist and the ends of the strips brought around and joined together, in the fashion of an ordinary mobius strip. This operation, performed on the aforementioned special strips, will create the static electricity resistant container.

The strips are unique in their construction. They will be made of a non conductive material. The strips themselves will have internal conductive wires equally spaced and aligned lengthwise. The strips will be considered to have an "A" and a "B" side. The lengthwise edges of the strips will be rounded. The "A" side will be coated with an electrically conductive material. This coating will extend over both the edges and cover an optional amount of the "B" side (though equally covered from either edge). The remaining uncovered area of the "B" side may be used to locate a circuit. The "B" sides are placed facing each other in the aforementioned construction process; though not in actual contact (a non conductive spacer may be used to maintain a constant space between the "B" sides).

The principle involved is that static electricity will not readily enter an internal surface, as demonstrated by Faraday. Any static electricity which would pose a problem for the circuits placed on the "B" side would have to enter the internal space formed by the two closely facing "B" sides. The rounded edges would allow the static electricity to collect on the "A" sides which would form a ground. The "A" sides themselves, being joined end to end, form a single surface as in a mobius strip. This continuous external "A" surface would resist forming a dipole, further hampering the introduction of static electricity to the surface. If further protection were desired, the internally located wires could be tapped and a faraday cage created, keeping in mind a beneficial characteristic of the mobius strip is that electrical polarity is preserved and sympathetic within the internal wires in the two facing strips. The strips would be economical to manufacture and the resulting psuedo-mobius structure is self supporting and resilient.

I claim:

1. A psuedo-mobius static-resistant circuit container to prevent the introduction of static electricity to electrical circuits housed therein and comprising: a pair of strips of non-conductive material each coated on one side with an electrical conductive material sandwiched together to form a container having two ends and having the electrical conductive surfaces on the outside thereof, the container being given a 180 degree twist and joined at the ends to form a psuedo-mobius strip.

2. The container according to claim 1 further comprises conductive wires imbeded in each strip.

3. The container according to claim 1 wherein the electrical conductive coating on each strip extends over both edges thereof.

* * * * *